US011744432B1

(12) United States Patent
Ross

(10) Patent No.: US 11,744,432 B1
(45) Date of Patent: Sep. 5, 2023

(54) ADJUSTABLE DUSTING TOOL AND RELATED METHOD

(71) Applicant: CONTEC, INC., Spartanburg, SC (US)

(72) Inventor: Layne Z Ross, Simpsonville, SC (US)

(73) Assignee: CONTEC INC., Spartanburg, SC (US)

( * ) Notice: Subject to any disclaimer, the term of this patent is extended or adjusted under 35 U.S.C. 154(b) by 291 days.

(21) Appl. No.: 16/867,084

(22) Filed: May 5, 2020

Related U.S. Application Data

(60) Provisional application No. 62/843,960, filed on May 6, 2019.

(51) Int. Cl.
*A47L 13/38* (2006.01)
*A47L 13/44* (2006.01)
*A46B 5/00* (2006.01)

(52) U.S. Cl.
CPC ..... *A47L 13/38* (2013.01); *A47L 13/44* (2013.01); *A46B 5/0037* (2013.01); *A46B 5/0058* (2013.01)

(58) Field of Classification Search
CPC ..... A47L 13/38; A47L 13/42; A47L 13/44; A47L 13/46; A47L 13/20; A47L 13/254
USPC ..... 15/231
See application file for complete search history.

(56) References Cited

U.S. PATENT DOCUMENTS

| | | | | |
|---|---|---|---|---|
| 4,683,875 | A * | 8/1987 | Rabinowitz | A61H 13/00 601/141 |
| 7,219,386 | B2 * | 5/2007 | Tsuchiya | A47L 13/42 285/302 |
| 7,784,141 | B2 * | 8/2010 | Knopow | A47L 13/38 15/210.1 |
| 10,653,288 | B2 * | 5/2020 | Batchelor, Jr. | A47L 13/38 |
| 11,458,515 | B2 * | 10/2022 | Harrington | B08B 9/0436 |
| 11,564,549 | B1 * | 1/2023 | Ancheta | A47L 13/44 |
| 2017/0231456 | A1 * | 8/2017 | Weilage | A46B 7/042 15/144.4 |

OTHER PUBLICATIONS

Stainless Steel 316L-50'-20 Gauge Wire, https://www.amazon.com/Stainless-Steel-316L-Gauge-Wire/dp/B07CJLTNR4/, date first available Apr. 19, 2018. (Year: 2018).*
Jehbco Silicones, https://jehbco.com.au/silicone-hardness-shore-durometer/, Jun. 18, 2017. (Year: 2017).*

* cited by examiner

*Primary Examiner* — Laura C Guidotti
(74) *Attorney, Agent, or Firm* — J.M. Robertson LLC

(57) ABSTRACT

A manual dusting tool incorporating a handle connected to an elongated bendable paddle member adapted for insertion into a textile sock structure for use in dusting hard-to-access surfaces. The bendable paddle member may be deformably bent in either one or two directions to adopt a curved or serpentine shape as may be desired for cleaning.

12 Claims, 4 Drawing Sheets

ADJUSTABLE DUSTING TOOL AND RELATED METHOD

CROSS-REFERENCE TO RELATED APPLICATION(S)

This non-provisional application claims the benefit of, and priority from U.S. provisional application 62/843,960 having a filing date of 6 May 2019, the teaching of which are incorporated herein by reference in their entirety.

TECHNICAL FIELD

The present disclosure relates generally to cleaning products, and more particularly to a manual dusting tool adapted to engage a removable cleaning element.

BACKGROUND

Manual dusters adapted to engage disposable or reusable cleaning elements are generally known. In one previous known construction, a manual duster incorporates a handle connected to an elongated fork structure. The prongs of the elongated fork structure may be inserted into complementary pockets in a high surface area fibrous cleaning element constructed to emulate a classic feather duster. While such prior constructions may be effective, they are not well adapted to engage and clean surfaces in planes perpendicular to the handle. Thus, a surface such as the top of a cabinet or the like cannot be easily accessed from a lower elevation for cleaning. This may require an operator to use a ladder or other structure to gain access to the surface to be cleaned. Thus, cleaning may take a prolonged period to complete. Also, in such prior constructions, the cleaning element may tend to slip off the elongated fork structure during use. In this regard, if the cleaning element becomes disengaged, a user may then be required to retrieve the soiled cleaning element and/or attach a replacement. Such retrieval and replacement may be unsanitary and frustrating to users.

In current practice, dusters for professional cleaning predominantly incorporate flat paddle designs formed from closed cell foam. Such tools typically use microfiber socks that slide over the paddle and usually have a snap button or elastic on the bottom to secure the textile to the hardware. One shortcoming with such prior designs is a lack of loft in the textile combined with a paddle that has substantially no compression in the foam. As markets gravitate towards the use of disposable cleaning textiles, heavy/lofty textiles may be cost prohibitive.

Considering the various noted problems associated with current manual dusters, an alternative construction which facilitates cleaning surfaces in multiple planes simultaneously while also eliminating the propensity for the cleaning element to be disengaged would represent a useful advancement over the current art.

SUMMARY

The present disclosure offers advantages and alternatives over the prior art by providing a manual dusting tool incorporating a handle connected to an elongated bendable paddle member adapted for insertion into a textile sock structure for use in dusting hard-to-access surfaces. The bendable paddle member may be deformably bent in either one or two directions to adopt a curved or serpentine shape as may be desired for cleaning. Despite bending, a sock-shaped cleaning element may be held in covering relation over the paddle member. The cleaning element may be held against slippage by a plurality of flexible fins disposed across one or both surfaces of the paddle member. The flexible fins are preferably angled towards the handle to facilitate insertion of the paddle member into the cleaning element while also providing resistance against unintended removal. The bendable paddle can be readily reshaped as may be desired to accommodate multiple different cleaning surfaces. The new paddle design with compressible fins mimics to a certain extent a heavy/lofty textile while retaining a rather light cost-effective textile used in an efficient manner.

In accordance with one exemplary aspect, the present disclosure provides and adjustable hand-manipulated dusting tool including a rear handle and a forward elongated paddle element having a length dimension extending in a direction away from the rear handle. The paddle element includes a malleable spine disposed in sandwiched relation between a pair opposing panels of flexible rubber or plastic. At least one of the opposing panels of flexible rubber or plastic includes a plurality of outwardly projecting fins oriented in a ladder rung pattern transverse to the length dimension and angled towards the rear handle. The paddle element is adapted to be received within a textile sock and is reversibly bendable to adopt a curved or serpentine profile along the length dimension.

BRIEF DESCRIPTION OF THE DRAWINGS

The accompanying drawings, which are incorporated in, and which constitute a part of this specification, illustrate exemplary constructions and procedures in accordance with the present disclosure and, together with the general description of the disclosure given above and the detailed description set forth below, serve to explain the principles of the disclosure wherein.

Figure 1:
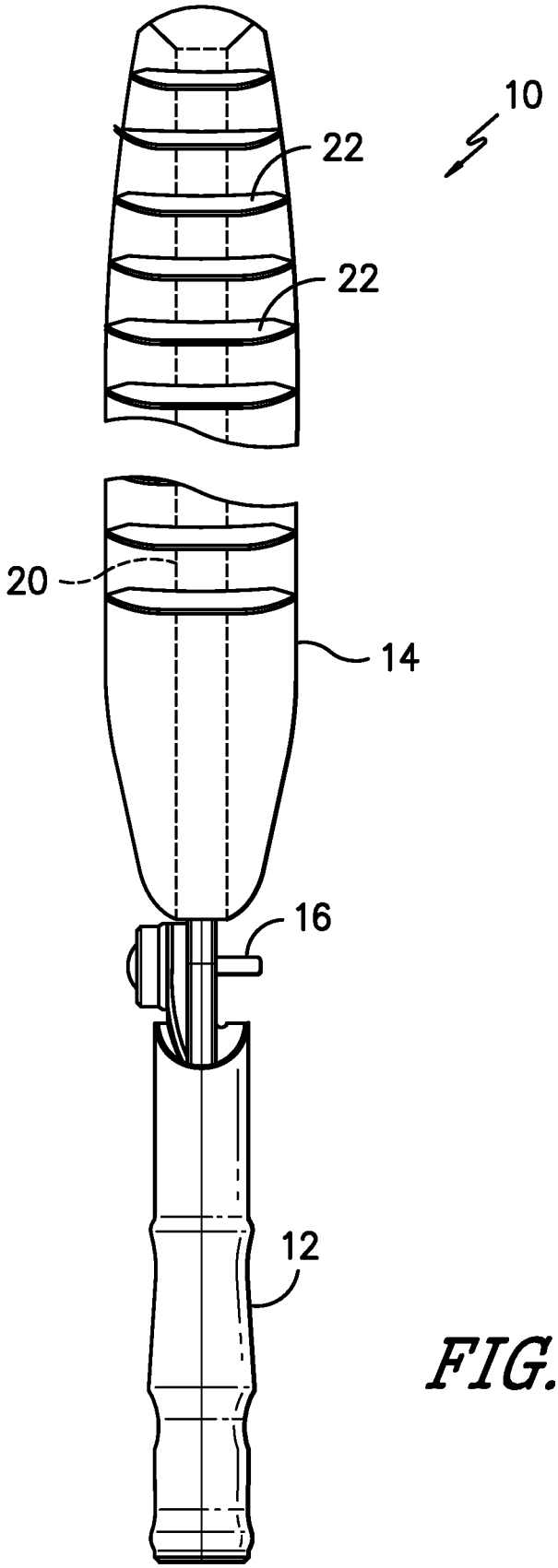
FIG. 1 is a schematic elevation plan view of a manual dusting tool consistent with the present disclosure.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF POTENTIALLY PREFERRED EMBODIMENTS

An exemplary embodiment consistent with the present disclosure will now be described in reference to the drawings wherein like elements are designated by like reference numerals in the various views. Referring now to the drawings, a manual dusting tool 10 consistent with the present disclosure is illustrated. As shown, the manual dusting tool 10 includes a handle 12 and an elongated paddle member 14 projecting outwardly away from the handle. In the illustrated exemplary construction, the paddle member 14 is rotatable relative to the handle about a pivot 16. In this regard, an adjustment mechanism such as thumbwheel, wingnut, or the like (not shown) may be used to loosen the connection between the handle 12 and paddle member 14 to permit relative rotation. Once a desired orientation is achieved, the adjustment mechanism can then be re-tightened to hold the handle 12 and paddle member 14 in that orientation.

In accordance with one exemplary construction, the paddle member 14 may be formed from rubber of flexible plastic such as silicone rubber, NBR, SBR, LDPE, EPDM or the like. The rubber or flexible plastic forming the paddle member preferably has a Shore A hardness in the range of about 50-80 A and more preferably about 60-70 A although harder or softer materials may likewise be used if desired. The rubber or flexible plastic may be molded over and substantially centrally oriented around an elongated malleable spine 20 such as a rod or flat plate using techniques such as injection molding or the like. By way of example only, and not limitation, suitable materials for the spine 20 may be metals such as austenitic stainless-steel alloys and the like that can be readily bent to different shapes by a user without undergoing bulk strain hardening. Exemplary suitable alloys may include stainless grades 304, 304L, 316, 316L and other similar corrosion resistant ferrous alloys. The paddle member 14 can thereby be repeatedly bent to various angles of 0-360 degrees or more to form curves, circles and the like as may be desired. Of course, other malleable spine materials and over-molded coverings may likewise be used if desired.

The paddle member 14 may also be bent in opposing directions along its length to adopt a serpentine shape if desired. As will be appreciated, the ability to bend the spine 20 away from its normal flat plane in two opposing directions permits the paddle member 14 to reversibly adopt and retain configurations such as curves and serpentine patterns which can then be maintained during use. In this regard, it will be understood that following bending, the spine 20 can then be re-flattened such that the paddle member is returned to its initial state if desired. The combination of bending and rotation relative to the handle 12 provides a user with the ability to adjust the device as necessary to clean a large variety of surfaces.

In one exemplary construction, two opposing soft panels of rubber or flexible plastic cover the spine 20 in a sandwiched relation. The soft panels are fused or adhesively joined to one another or otherwise connected at zones outboard from the spine such that the spine 20 is entirely encapsulated. As illustrated, one or both soft panels covering the spine may be molded to incorporate a plurality of integral, raised flexible fins 22 oriented generally transverse to the length dimension of the paddle member 14 in a ladder rung orientation.

Figure 2:
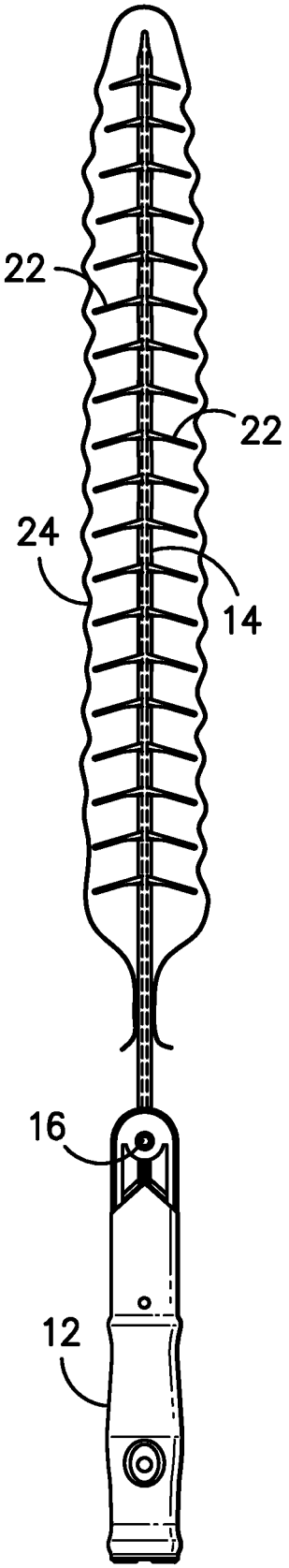
FIG. 2 is a cut-away side view of the manual dusting tool of FIG. 1 with the paddle structure inserted into a sock-like cleaning element.
Figure 4:
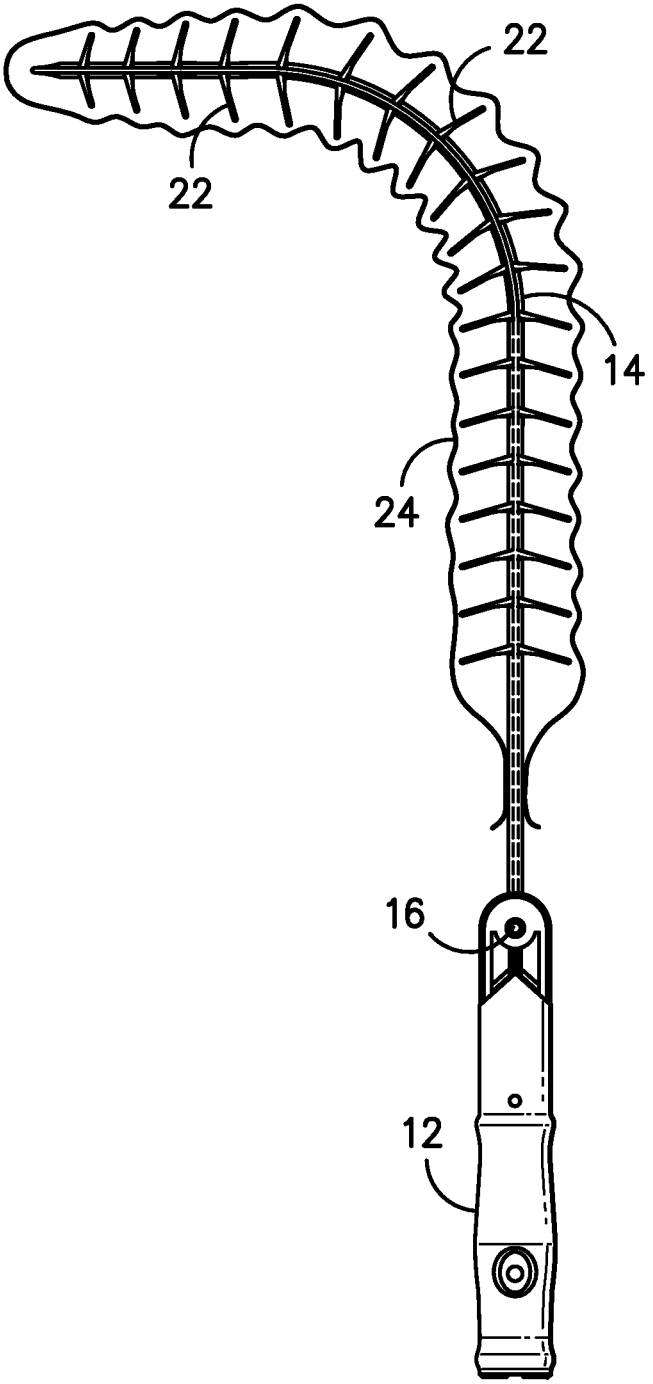
FIG. 4 is a cut-away side view of the manual dusting tool of FIG. 1 with the paddle structure inserted into a sock-like cleaning element and with the paddle structure reversibly bent into a curve to facilitate cleaning surfaces in multiple planes simultaneously.

As best seen in FIGS. 2 and 4, the flexible fins 22 provide a resilient underlying support structure for a replaceable and launderable sock-shaped cleaning element 24 of fibrous textile material or the like. In this regard, the cleaning element may have any number of constructions, but is preferably a tube enclosed on three sides to define a single channel at the interior to matedly receive the paddle member 14 in sliding relation. The flexible fins 22 act to hold the cleaning element 24 in an expanded condition surrounding the paddle member thereby simulating a high-loft textile structure. During use, flexible fins 22 may flex up and down at different locations as force is applied during the cleaning operation. This dynamic movement of localized fins 22 beneath the cleaning element 24 further facilitates cleaning efficiency by permitting the cleaning element to continuously adjust and conform more precisely with the surface being cleaned in real time during use.

As shown, in the illustrated exemplary construction, the flexible fins 22 are molded to project rearwardly towards the handle 12 at an angle. In this regard, the flexible fins will preferably lean towards the handle to form an acute angle relative to the surface of the supporting panel in the range of about 35 to 85 degrees, and more preferably about 50 to 85 degrees. However, larger and smaller angles may be used if desired. As will be understood, this orientation for the fins 22 facilitates insertion of the paddle member 14 into the sock-shaped cleaning element 24 (FIGS. 2 and 4) of fibrous textile material or the like by permitting the fins to bend downwardly thereby decreasing the acute angle. The rearwardly angled orientation for the fins 22 also assists in blocking any unintended extraction of the paddle member 14 from the cleaning element 24 during use by forcing the fins to bend away from their molded orientation and away from the handle as the cleaning element is removed. Thus, in the absences of an intended applied removal force, the cleaning element 24 will remain in place.

Figure 3:
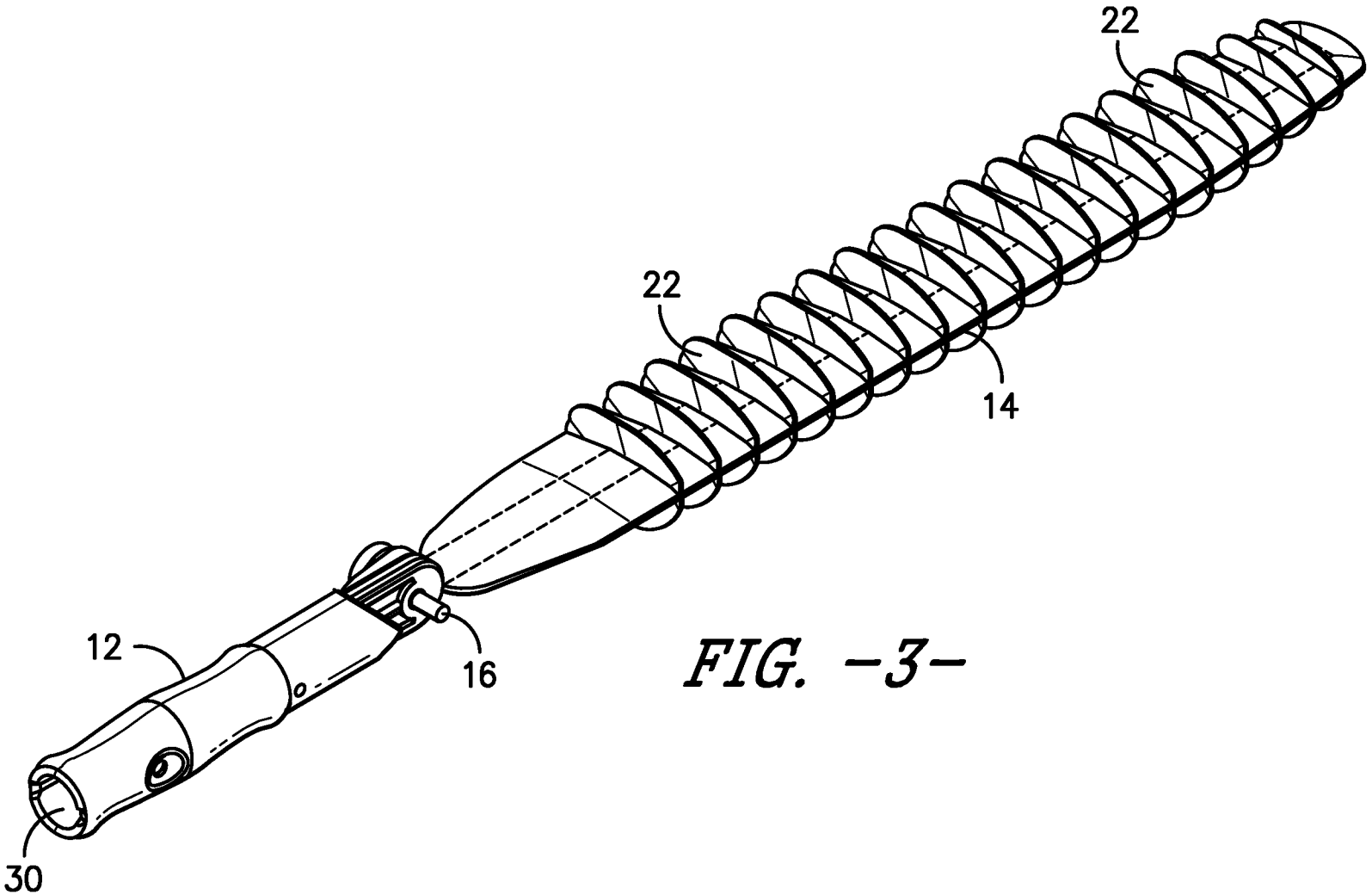
FIG. 3 is a perspective view of the manual dusting tool of FIG. 1.

As best seen in FIG. 3, the handle 12 also preferably includes a receiving opening 30 at its proximal end. During use, this receiving opening 30 may engage an elongated extension pole (not shown) to extend a user's reach in a manner as will be well understood by those of skill in the art. However, the use of such an extension pole is in no way essential.

The ability to contour the paddle member 14 to multiple different shapes while also adjusting the relative angle of the paddle member and securely holding the sock-shaped cleaning element 24 in place during use provides substantial advantages over existing hand-held dusting tools. In particular, a dusting tool 10 consistent with the present disclosure is far more adaptable to reach contoured surfaces in difficult-to-access locations. By way of example only, and not limitation, FIG. 4 illustrates the dusting tool 10 bent in a curved orientation such that a distal portion of the tool may be used to clean an elevated horizontal surface such as the top of an air duct or cabinet while the proximal portion may be used to simultaneously clean a vertical side surface. Such a curved surface may also be beneficial in cleaning elevated curved surfaces such as overhead piping which may be present in many industrial settings.

Of course, it is to be understood that variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An adjustable hand-manipulated dusting tool comprising:

a rear handle;

a forward elongated paddle element having a length dimension extending in a direction away from the rear handle, the paddle element comprising a malleable spine disposed in sandwiched relation between a pair opposing panels of flexible rubber or plastic, wherein at least one of the opposing panels of flexible rubber or plastic includes a plurality of outwardly projecting fins oriented in a ladder rung pattern transverse to the length dimension and angled towards the rear handle, wherein all of the plurality of outwardly projecting fins are in an angled orientation towards the rear handle to form an acute angle relative to a surface of the underlying panel in a range of 35-85 degrees, wherein the paddle element is adapted to be received within a textile sock and is reversibly bendable to adopt a curved or serpentine profile along the length dimension.

2. A dusting tool as recited in claim 1, wherein the handle is hollow along its length and includes an axial opening adapted to matingly receive an elongated pole element.

3. A dusting tool as recited in claim 1, wherein the paddle element is disposed in rotatable relation to the rear handle about a lockable pivot axis.

4. A dusting tool as recited in claim 1, wherein the malleable spine is a metal plate or rod.

5. A dusting tool as recited in claim 4, wherein the malleable spine is formed from an austenitic ferrous alloy.

6. A dusting tool as recited in claim 5, wherein the ferrous alloy is selected from the group consisting of grades 304, 304L, 316 and 316L stainless steel.

7. A dusting tool as recited in claim 1, wherein the opposing panels of flexible rubber or plastic are disposed in over-molded relation to the malleable spine.

8. A dusting tool as recited in claim 7, wherein the opposing panels of flexible rubber or plastic have a Shore A hardness in the range of 50-80 A.

9. A dusting tool as recited in claim 8, wherein the opposing panels of flexible rubber or plastic are formed from silicone rubber.

10. A dusting tool as recited in claim 1, wherein the opposing panels of flexible rubber or plastic are adjoined to one another by fusion at locations outboard from the malleable metal spine.

11. A dusting tool as recited in claim 1, wherein each of the opposing panels of flexible rubber or plastic includes a plurality of outwardly projecting fins oriented in a ladder rung pattern transverse to the length dimension and angled towards the rear handle.

12. An adjustable hand-manipulated dusting tool comprising:

a hollow rear handle including an axial opening adapted to matingly receive an elongated pole element;

a forward elongated paddle element having a length dimension extending in a direction away from the rear handle, the paddle element being disposed in rotatable relation to the rear handle about a lockable pivot axis, the paddle element comprising a malleable metal spine of austenitic stainless steel disposed in sandwiched relation between a pair of over-molded opposing panels of silicone rubber having a Shore A hardness in the range of 50-80 A, the opposing panels of flexible rubber or plastic being adjoined to one another by fusion or adhesive bonding at locations outboard from the malleable metal spine, wherein each of the over-molded opposing panels includes a plurality of outwardly projecting fins oriented in a ladder rung pattern transverse to the length dimension, wherein all of the outwardly projecting fins are in an angled orientation towards the rear handle to form an acute angle relative to a surface of the underlying panel in the range of about 50-85 degrees, wherein the paddle element is adapted to be received within a textile sock and is reversibly bendable to adopt a curved or serpentine profile along the length dimension.

* * * * *